US005430600A

United States Patent [19]

Burns

[11] Patent Number: 5,430,600

[45] Date of Patent: Jul. 4, 1995

[54] LATCHING RELAY CONTROL CIRCUIT

[75] Inventor: Martin J. Burns, Derwood, Md.

[73] Assignee: Honeywell Inc., Minneapolis, Minn.

[21] Appl. No.: 7,454

[22] Filed: Jan. 22, 1993

[51] Int. Cl.[6] ..... H01H 47/32

[52] U.S. Cl. ..... 361/153; 361/172; 307/141

[58] Field of Search ..... 361/152, 153, 160, 166, 361/168.1, 169.1, 186, 195, 172; 307/132 E, 141

[56] References Cited

U.S. PATENT DOCUMENTS

| | | | |
|---|---|---|---|
| 4,408,251 | 10/1983 | Kaplan | 361/172 |
| 4,631,627 | 12/1986 | Morgan | 361/186 |
| 4,907,122 | 3/1990 | Tamura | 361/186 |
| 5,196,730 | 3/1993 | Matsuo | 361/186 |

*Primary Examiner*—Jeffrey A. Gaffin

*Assistant Examiner*—Peter Ganjoo

*Attorney, Agent, or Firm*—Ian D. Mackinnon

[57] ABSTRACT

A latching relay control circuit comprising a latching relay pulse generator circuit and a relay coil drive circuit, the latching relay pulse generator circuit receiving relay control signals and relay reset signals. When a relay control signal changes states, the latching relay pulse generator provides a pulsed signal to the relay and coil drive circuit, the relay and coil drive circuit then changing the state of a latching relay. The relay reset signal is provided during power-up or just before power is lost to the system, the relay reset signal being provided to the latching relay pulse generator circuit wherein the latching relay pulse generator circuit provides a reset signal to the relay and coil driver circuit, and the relay and coil driver circuit opens all of the latching relays it controls.

4 Claims, 3 Drawing Sheets

| RELAY CONTROL | | RELAY RESET | OPEN COIL 32 | CLOSE COIL 33 |
|---|---|---|---|---|
| INITIAL | 0 | 0 | 0 | 0 |
| DELAY | 0 | 0 | 0 | 0 |
| INITIAL | 1 | 0 | 0 | 1 |
| DELAY | 1 | 0 | 0 | 0 |
| INITIAL | 0 | 0 | 1 | 0 |
| DELAY | 0 | 0 | 0 | 0 |
| INITIAL | 0 | 1 | 1 | 0 |
| DELAY | 0 | 0 | 0 | 0 |
| | | | | |

TRUTH TABLE

Fig. 4

LATCHING RELAY CONTROL CIRCUIT

BACKGROUND OF THE INVENTION

The present invention pertains to relay control circuits. More particularly, it pertains to a means for providing control signals for a latching relay and for resetting said relays when power is interrupted.

Power relays of substantial current-handling capability, approximately two amp inductive loads, are required for HVAC (heating, ventilation and air conditioning) control. The relays available of the continuously powered kind require a substantial holding current to operate. It is desirable to be able to operate a control system on a small power supply to eliminate the need for active heat removal and, if possible, permit the use of a battery backup power supply of modest size. Since a control system may need to control multiple relays, the level of power for conventional relays cannot be made available from a small power supply system.

Latching relays have the benefit of only requiring power when they need to change state. The difficulty in using these relays is they need to be given a deliberate timed pulse to open or close. Further, their state is unknown when a power failure occurs. Thus, it is desired to find a simple means of providing a means to force the relays to the off position upon a power failure or at initial power-up.

SUMMARY OF THE INVENTION

The invention utilizes a single resistor and capacitor along with four logical NOR gates to implement the relay switching logic. The resistor and capacitor form an RC time constant which is used to time the pulses given to actuate the relays. The capacitor also serves the role of memory for the current state of the relay. Thus, this state is continuously compared to the program state via a digital signal. When the relay control signal changes, the difference relative to the voltage on the capacitor is used to generate a timing pulse sent to a relay driver IC.

Finally, using an unused input on the NOR gates, a reset pulse is provided to all relay circuits, resulting in a forced off pulse to all relays. A capacitor for each relay card is used as an energy storage tank to permit the relays to be actuated to their off position after the power failure has been detected.

BRIEF DESCRIPTION OF THE DRAWING

FIG. 4 is a truth table for FIG. 2 and FIG. 3.

DESCRIPTION OF THE PREFERRED EMBODIMENT

Figure 1:
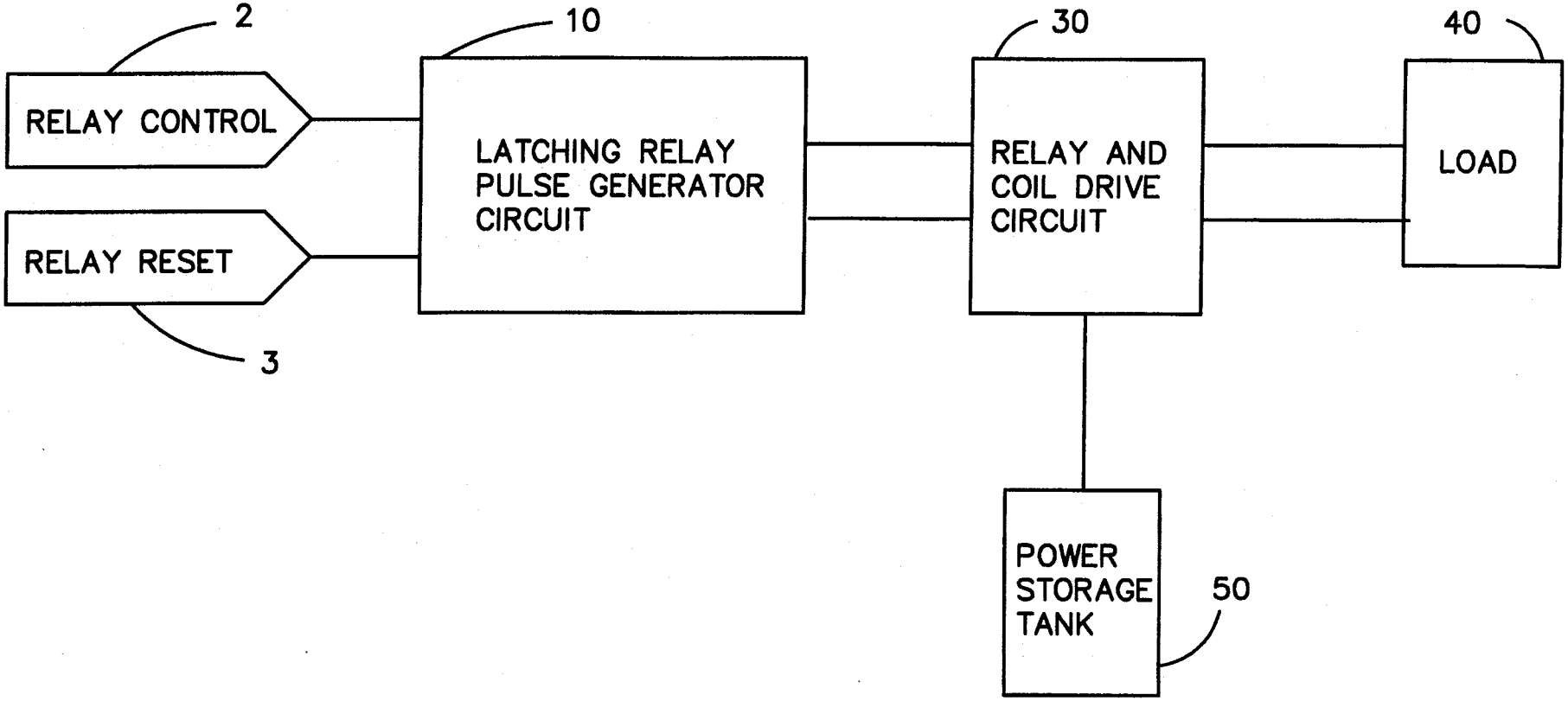
FIG. 1 illustrates a block diagram of the latching relay control circuit.

FIG. 1 illustrates a basic block diagram of the latching relay control circuit. The latching relay control circuit comprises pulse generator circuit 10, relay and control drive circuit 30, load 40, and power storage tank 50. A relay control signal 2 is provided by an outside source. The relay control signal is provided to pulse generator circuit 10 wherein, upon receiving relay control signal 2, pulse generator circuit 10 determines if relay control signal 2 is an open signal or a close signal. A close signal is generally a digital logic level one and an open signal is generally a digital logic level zero. This convention was utilized for the embodiments disclosed in this application. Relay control signal 2 will provide a constant logic one or a logic zero until the operator or control means determines that the relay should change states, at which time relay control signal 2 will change states. Since relay control signal 2 provides a constant logic level one, and to close the latching relays utilized in relaying and coil drive circuit 30 requires pulsed signals to change states, latching relay pulse generator circuit 10 provides a pulse signal to relay and coil drive circuit 30, whereupon relay and coil drive circuit 30 can initiate a change in the state of a latching relay and either energize or de-energize load 40. Pulse generator circuit 10 also receives relay reset signal 3 which can be provided by an external source such as a watchdog circuit or it can be provided by an internal source such as a power-up reset circuit. When latching relay pulse generator circuit 10 receives a relay reset signal 3, latching relay pulse generator circuit 10 will send a reset pulse to relay and coil drive circuit 30 which will de-energize load 40. When relay reset 3 provides a logic level 1, relay control 2 must be at a logic level 0. This is accomplished by requiring the external source to reset the relay control before sending a logic level 1 to relay reset 3. A watchdog circuit monitors the power supply input and alerts the system to an imminent loss of circuit power. For instance, when a power failure occurs, the power failure will be detected before the control circuits will de-energize to a point where they will no longer function. A watchdog circuit can be utilized to detect when power is interrupted. A reset signal can be sent to pulse generator circuit 10 which will send a reset pulse to relay and coil drive circuit 30. Relay and coil drive circuit 30 resets or opens each of the relays utilizing the power stored in power storage tank 50. Thus, even though power is no longer provided to the circuit, the circuit can go to a safety mode by de-energizing load 40.

Figure 2:
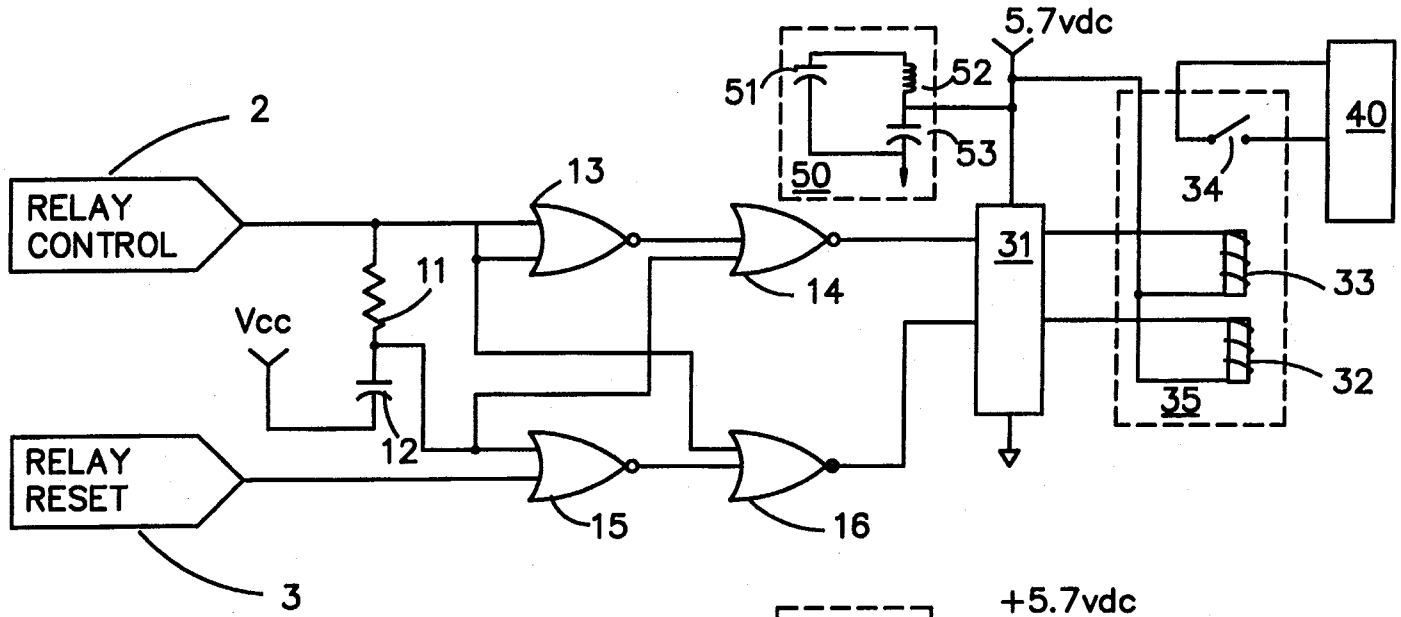
FIG. 2 illustrates a first embodiment of FIG. 1.

FIG. 2 illustrates a first embodiment of the invention wherein the pulse generator circuit 10 comprises resistor 11, capacitor 12, and NOR gates 13, 14, 15 and 16. Relay and coil driver circuit 30 comprises a relay driver IC 31 which, for this embodiment is a ULN2803A eight-channel relay driver. Relay and coil drive circuit 30 further comprises latching relay 35 which comprises coil 33, coil 32 and switch 34. The latching relay utilized in this embodiment is an Aromat DSP1AE-L2-DC6V two-coil latching relay. Each NOR gate of latching relay pulse generator circuit 10 comprises a two-input NOR gate. Relay control signal 2 is provided to both inputs of NOR gate 13 and a first input of NOR gate 16. Relay control signal 2 is also provided to resistor 11. Resistor 11 is electrically connected to capacitor 12 which is electrically connected to the voltage source $V_{CC}$. The junction between resistor 11 and capacitor 12 is electrically connected to a first input of NOR gate 15. In this manner, when relay control 2 switches states, an RC time constant delays the signal by either charging or discharging capacitor 12, thus creating the delay signal at the first input of NOR gate 15. The delayed relay control signal is further provided to the second input of NOR gate 14. Relay reset 3 provides a relay reset signal to the second input of NOR gate 15. The output of NOR gate 15 is provided to the second input of NOR gate 16. As illustrated in FIG. 4, the truth table for this circuit shows that originally a logic one signal from the output of NOR gate 14 will be provided to relay driver IC 31 when a logic one is detected at relay control 2. However, upon capacitor 12 being discharged, a logic one will be provided to the input of NOR gate 14 and a logic zero will be output from NOR gate 14 and provided to relay driver IC 31. In this way, the necessary pulse to relay core 33 will be provided to switch the state of relay switch 34. By utilizing the truth table of FIG. 4, it is clear that a relay control level zero following a relay control signal one will energize relay coil 32 in a similar manner. When relay reset 3 is provided to NOR gate 15, a logic one signal is provided to relay driver IC 31 and relay core 32 is energized and opens relay switch 34. Relay reset signal 3 must be a pulsed signal and is generally utilized during power-up, as illustrated in FIG. 3, or during a power shutdown prior to the circuit losing all power.

Power storage tank 50 comprises inductor 52, capacitor 51 and capacitor 53. Power storage tank 50 provides power to relay and coil driver circuit 30 in the event of power loss. Power storage tank 50 should be designed to allow for the latching relays to open.

Figure 3:
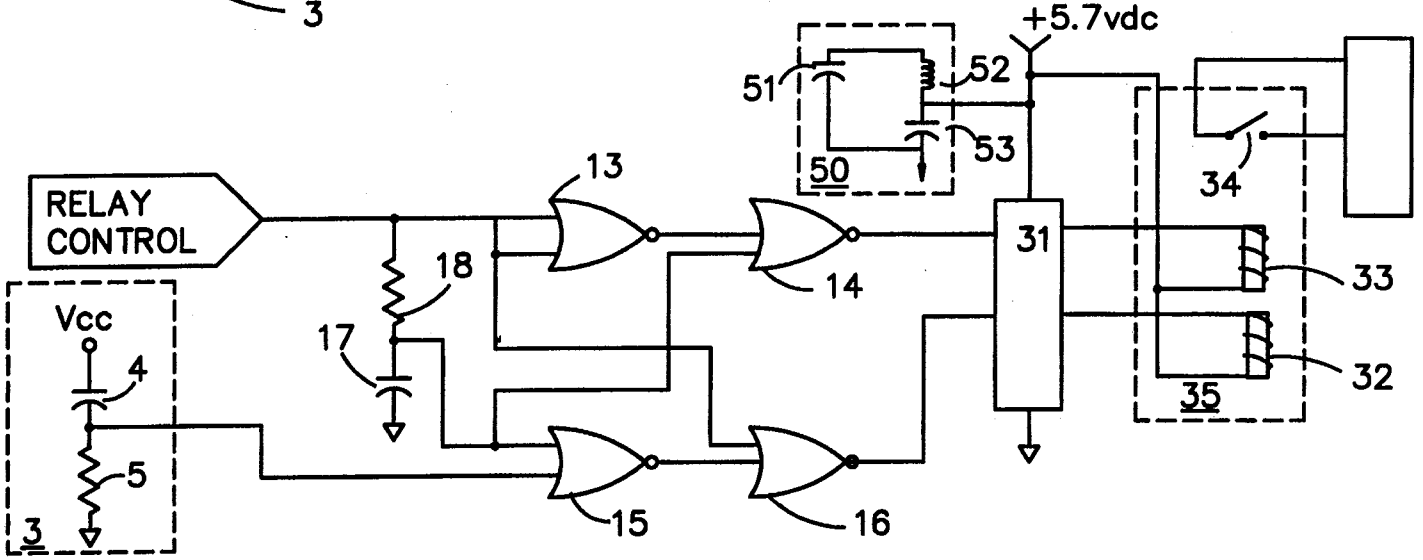
FIG. 3 illustrates a second embodiment of FIG. 1 wherein a power on reset circuit is provided.

FIG. 3 illustrates an embodiment similar to that of FIG. 2. However, relay reset 3 is now illustrated with a power on relay reset circuit. Power on relay reset circuit 3 comprises capacitor 4, which is electrically connected to $V_{CC}$, and resistor 5, resistor 5 being electrically connected to ground. The node between resistors 5 and capacitor 4 is electrically connected to the second input of NOR gate 15. When the system is first powered on, capacitor 4 is in a discharged state and thus node A is electrically high and the equivalent of a logic level one. For the circuit to operate properly at power up relay control 2 must be at a logic level 0. Thus, as illustrated earlier in FIG. 2, a reset signal is provided to relay driver IC 31. As the circuit comprising resistor 5 and capacitor 4 is an RC circuit, capacitor 4 eventually is charged and node A is a logic level zero and the output from NOR gate 16 becomes a logic level zero. In this manner, an adequate pulse is provided to relay driver IC at the power-up of the latching relay control circuit such that relays 35 are open and the system is able to determine what all of the current states are.

I claim:

1. A latching relay control circuit comprising:

a pulse generator circuit for receiving a relay control input and a relay reset input, said pulse generator circuit providing an open pulse or a close pulse in accordance with the relay control input, said pulse generator circuit providing an open pulse when said relay reset provides a reset signal;

a relay and coil drive circuit comprising latching relays wherein, when an open pulse is received from said pulse generator circuit, said relay and coil drive circuit opens said relay and when said pulse generator circuit provides a close pulse, said relay and coil drive circuit closes said relay wherein said pulse generator circuit comprises a delay circuit and a logic circuit, said logic circuit comprising four NOR gates, each having two inputs, said relay control signal being provided to both inputs of said first NOR gate and a first input of said fourth NOR gate, a first input of said second NOR gate receiving an output of said first NOR gate, said delay circuit receiving said relay control signal, said delay circuit providing said relay control signal to a first input of said third NOR gate and said second input of said second NOR gate a predetermined delayed period of time later than said relay control signal is provided to said first NOR gate, a second input of said third NOR gate receiving said relay reset signal, said fourth NOR gate receiving an output of said third NOR gate, said second NOR gate providing said closed signal to said relay and coil drive circuit, and said fourth NOR gate providing an open signal to said relay and coil drive circuit.

2. The latching relay control circuit of claim 1 further comprising a power on relay reset circuit, said power on relay reset circuit providing a relay reset when said latching relay control circuit is energized.

3. The latching relay control circuit of claim 1 wherein said relay and coil drive circuit comprises a relay driver and a latching relay wherein said relay driver receives said close pulses and said open pulses, said relay driver providing open and close pulses to said latching relay.

4. The latching relay control circuit of claim 3 further comprising a power storage tank to provide power to said relay and coil drive circuit when power from external sources is no longer present, wherein said pulse generator circuit resets said relay and coil drive circuit when power from external sources is no longer present.

* * * * *